US007527050B2

(12) United States Patent
Corcoran, Jr.

(10) Patent No.: US 7,527,050 B2
(45) Date of Patent: May 5, 2009

(54) METHOD FOR FABRICATING MULTI-LAYER, HUB-LESS BLADE

(75) Inventor: Robert F. Corcoran, Jr., Holden, MA (US)

(73) Assignee: Saint-Gobain Abrasives Technology Company, Worcester, MA (US)

( * ) Notice: Subject to any disclaimer, the term of this patent is extended or adjusted under 35 U.S.C. 154(b) by 0 days.

(21) Appl. No.: 11/436,369

(22) Filed: May 18, 2006

(65) Prior Publication Data

US 2006/0201281 A1 Sep. 14, 2006

Related U.S. Application Data

(62) Division of application No. 10/400,007, filed on Mar. 26, 2003, now Pat. No. 7,073,496.

(51) Int. Cl.
*B28D 1/04* (2006.01)
*B24D 11/00* (2006.01)

(52) U.S. Cl. ..... 125/15; 51/297; 51/309; 125/18; 451/57; 451/65; 451/533; 451/542

(58) Field of Classification Search ..... 125/12, 125/13.01, 15, 16.01, 18; 451/562, 533, 451/534, 541, 542, 543, 547, 57, 65; 51/297, 51/307, 309
See application file for complete search history.

(56) References Cited

U.S. PATENT DOCUMENTS 1,403,416 A * 1/1922 Katzenstein ..... 451/541
3,028,710 A * 4/1962 Pratt ..... 451/541
3,049,843 A * 8/1962 Christensen ..... 451/541
3,067,551 A * 12/1962 Maginnis ..... 451/49
3,127,715 A * 4/1964 Christensen ..... 451/541
3,802,130 A * 4/1974 Lindenbeck ..... 451/544
4,082,640 A 4/1978 Haack
4,128,136 A * 12/1978 Generoux ..... 175/405.1
4,131,436 A * 12/1978 Wiand ..... 51/309
4,293,617 A 10/1981 Nagy
4,381,227 A 4/1983 Narcus
4,505,251 A * 3/1985 Stoll ..... 125/15
4,555,315 A 11/1985 Barbieri et al.
4,883,500 A * 11/1989 Deakins et al. ..... 51/298
5,313,742 A 5/1994 Corcoran, Jr. et al.
5,318,604 A * 6/1994 Gorsuch et al. ..... 51/293
5,518,443 A * 5/1996 Fisher ..... 451/540
5,620,489 A * 4/1997 Tselesin ..... 51/293

(Continued)

OTHER PUBLICATIONS

International Search Report and Written Opinion mailed on Jun. 30, 2006, from related International Application No. PCT/US04/06578, filed Mar. 4, 2004..

(Continued)

*Primary Examiner*—Timothy V Eley
(74) *Attorney, Agent, or Firm*—Mike W. Crosby

(57) ABSTRACT

An abrasive cutting blade is provided to achieve high-quality surface finishes at high feed rates. The blade is fabricated by electroplating fine abrasive onto a steel cathode disc to form a first layer, followed by electroplating a second layer of coarser abrasive onto the first layer. A third layer of fine abrasive is then electroplated onto the second layer. The resulting composite is then removed from the cathode disc to form a multi-grit, multi-layer, hub-less blade.

27 Claims, 1 Drawing Sheet

U.S. PATENT DOCUMENTS

| | | | | |
|---|---|---|---|---|
| 5,791,330 | A * | 8/1998 | Tselesin | 125/15 |
| 6,187,071 | B1 * | 2/2001 | Andrews et al. | 51/309 |
| 6,273,082 | B1 | 8/2001 | Tselesin | |
| 6,286,498 | B1 * | 9/2001 | Sung | 125/12 |
| 6,416,560 | B1 * | 7/2002 | Palmgren | 51/309 |
| 6,609,965 | B2 * | 8/2003 | Fujioka | 451/547 |
| 6,824,578 | B2 * | 11/2004 | Uchino et al. | 51/307 |
| 2002/0168929 | A1 | 11/2002 | Fujioka | |

OTHER PUBLICATIONS

International Preliminary Report on Patentability dated Oct. 10, 2006, from related International Application No. PCT/US04/06578, filed Mar. 4, 2004.

* cited by examiner

METHOD FOR FABRICATING MULTI-LAYER, HUB-LESS BLADE

RELATED APPLICATION

This application is a divisional of U.S. patent application Ser. No. 10/400,007, entitled High Precision Multi-Grit Slicing Blade, filed on Mar. 26, 2003 now U.S. Pat. No. 7,073,496.

BACKGROUND

1. Technical Field

This invention relates to improved metal bond abrasive tools. More particularly, the present invention relates to improved diamond abrasive cutting tools having two or more electroplated layers of diamond particles, in which each layer has diamond particles of different size, to provide the benefits of relatively good surface finish and high feed rate.

2. Background Information

Superabrasives such as diamond and cubic boron nitride (CBN) have been widely used on saws, drills, and other tools to cut, form or polish other hard materials.

Diamond tools are particularly useful in applications where other tools lack the strength and durability to be practical substitutes. For example, diamond saws are routinely used in the stone cutting industry due to their hardness and durability. If superabrasives were not used, many such industries would be economically infeasible.

Despite the improvements provided by diamond and cubic boron nitride for cutting, drilling, and grinding tools, disadvantages still exist which, if overcome, may greatly improve tool performance, and/or reduce their cost.

A typical superabrasive tool, such as a diamond saw blade, is manufactured by mixing diamond particles with a suitable matrix (bond) powder. The mixture is then compressed in a mold to form the desired shape (e.g., a saw segment). The "green" form is then consolidated by sintering at a suitable temperature to form a single body with a plurality of superabrasive particles disposed therein. Finally, the consolidated body is attached (e.g., by brazing) to a tool body, such as to the round blade of a circular saw, to form the final product.

Abrasive tools using metal bond material have been used to fabricate slicing or cut-off discs. One such tool, commonly referred to as metal matrix composite (MMC) tool, may be formed by molding a mixture of abrasive and metal bond material. An example of such a tool is disclosed in U.S. Pat. No. 5,313,742, assigned to Norton Company of Worcester, Mass. As described therein, such discs may include porosity which varies from essentially zero porosity by volume to as much as 40 or 50% porosity by volume. The preferred volume percent composition of the discs are 5 to 50% by volume of abrasive, 50 to 95% by volume of bond, and 0 to 25% by volume of pores. The bond includes any of the metal bonds well known in the industry, used primarily to bond diamond and cubic boron nitride (CBN) abrasive grits. Examples of such metal bonding material are alloys such as Cu—Zn—Ag, Co—WC, Cu—Ni—Zn, Cu—Ni—Sb, Ni—Cu—Mn—Si—Fe, Ni—Cu—Sb—TaC.

Another type of metal bonded tool is formed by electroplating, such as set forth in U.S. Pat. No. 4,381,227, also assigned to Norton Company, and also fully incorporated by reference herein. This reference discloses placing a substrate within an electroless plating bath having abrasive grain dispersed therein. A direct current is applied through the bath with the substrate as the cathode and an electrode containing the plating metal being positioned in the bath as the anode.

This reference states that a current density in the case of a nickel plating electroless bath can be as low as from 1.5 to 5 amperes per square foot (1.4 to 4.6 mA/cm$^2$), but should preferably be from 50 to 100 amperes/ft$^2$.

The abrasive grits, which may be diamond, cubic boron nitride, silicon carbide, alumina, co-fused alumina-zirconia, or even flint, may be allowed to settle from suspension onto the substrate or may be positioned adjacent the substrate as by a carrier or basket.

Variations of the foregoing tools are often used as slicing or cut-off discs for cutting through hard materials such as hardened steel, or for cutting ceramics typically used in the electronics industry. The choice of abrasive size (grit size) generally entails a trade-off between feed rate and surface finish. For example, larger grit sizes may be used in cutting applications where high feed rate is of primary importance. The aforementioned MMC tools have generally been favored for such applications. Conversely, smaller grit sizes, often used with the aforementioned electroplated wheels, may be used in applications that require a high quality surface finish.

A need exists for an abrasive cutting tool that provides the heretofore mutually exclusive benefits of high feed rate and high quality surface finish.

SUMMARY

An aspect of the present invention includes a method for fabricating an abrasive cutting tool. The method includes providing a deposition disc having at least one deposition surface, placing the disc in a bath having a first grit size abrasive dispersed therein, and depositing a first layer of the first abrasive and electroplating material onto the deposition surface. The method further includes removing the disc from the bath, activating a surface of the first layer, and placing the disc in a bath having a second abrasive of a second grit size larger than that of the first grit size abrasive dispersed therein. Thereafter, a second layer of the second abrasive and electroplating material is deposited onto the first layer, the disc is removed from the bath, followed by activating a surface of the second layer, placing the disc in a bath having the first grit size abrasive dispersed therein, depositing a third layer of the first grit size abrasive and electroplating material onto the second layer; and removing the disc from the first layer. This method thus produces a multi-layered cutting tool having abrasive particulate dispersed substantially completely therethrough, with a central layer of second grit size abrasive disposed between two layers of first grit size abrasive.

Another aspect of the present invention includes a method for fabricating an abrasive cutting tool, which includes depositing a first layer of a first grit size abrasive and electroplating material onto a surface of a deposition member; depositing a second layer of a second grit size abrasive larger than the first grit size abrasive and electroplating material onto the first layer; depositing a third layer of a third grit size abrasive smaller than the second grit size abrasive and electroplating material onto the second layer, and configuring at least two of the first, second, and third sizes to be mutually distinct from one another. The deposition member is then removed from the first layer, to produce a multi-layered cutting tool having abrasive particulate dispersed substantially completely therethrough.

In a yet further aspect of the present invention, an abrasive slicing tool includes a first layer of electroplating having first-size abrasive particulate dispersed therein, the first size being within a range of about 4-8 microns; a second layer of electroplating having a second-size abrasive particulate dispersed therein, the second-size being within a range of about 10-20 microns; and a third layer of electroplating having the first-size abrasive particulate dispersed therein. The first, second, and third layers are superposed with one another; and the second layer is disposed between the first and third layers. The abrasive particulate is dispersed throughout the disc.

In a still further aspect of the invention, an abrasive slicing tool includes a first layer of electroplated metal having first-size abrasive particulate dispersed therethrough; a second layer of electroplated metal having a second-size abrasive particulate dispersed therethrough; and a third layer of electroplated metal having a third-size abrasive dispersed therethrough. The second-size abrasive particulate is larger than at least one of the first and second size abrasive particulate; and the second layer is disposed between the first and third layers.

BRIEF DESCRIPTION OF THE DRAWINGS

The above and other features and advantages of this invention will be more readily apparent from a reading of the following detailed description of various aspects of the invention taken in conjunction with the accompanying drawings, in which.

DETAILED DESCRIPTION

Figure 1:
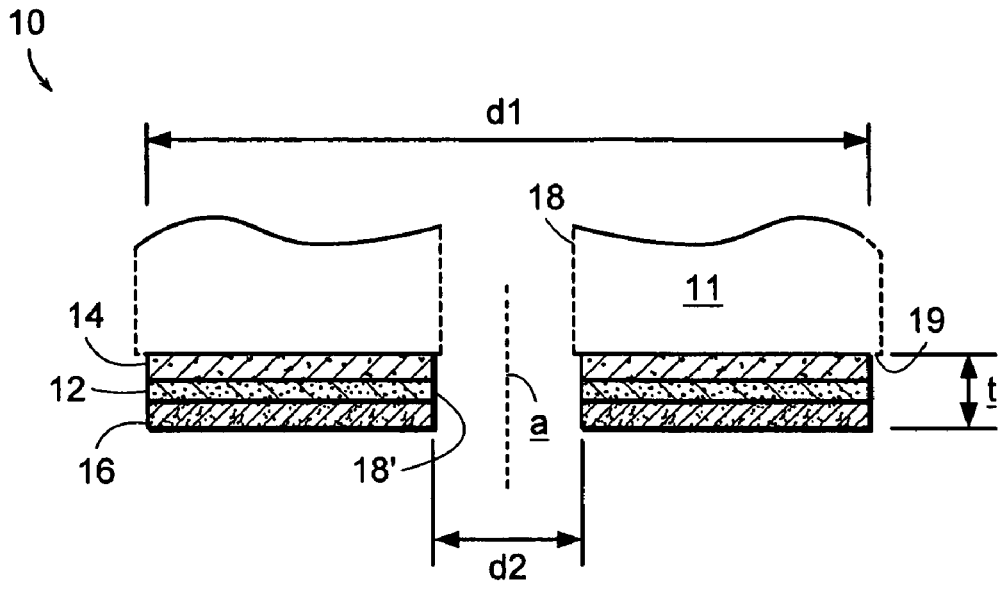
FIG. 1 is a transverse cross-sectional view of a circular abrasive cutting tool of the subject invention, with a portion of an apparatus used during fabrication of the tool shown in phantom.

In the following detailed description, reference is made to the accompanying drawings that form a part hereof, and in which is shown by way of illustration, specific embodiments in which the invention may be practiced. These embodiments are described in sufficient detail to enable those skilled in the art to practice the invention, and it is to be understood that other embodiments may be utilized. It is also to be understood that structural, procedural and system changes may be made without departing from the spirit and scope of the present invention. The following detailed description is, therefore, not to be taken in a limiting sense, and the scope of the present invention is defined by the appended claims and their equivalents. For clarity of exposition, like features shown in the accompanying drawings are indicated with like reference numerals and similar features as shown in alternate embodiments in the drawings are indicated with similar reference numerals.

Briefly, the present invention includes an abrasive cutting blade capable of achieving relatively high-quality surface finishes, while also achieving relatively high feed rates. As shown in FIG. 1, an embodiment of the invention includes a tool 10 fabricated with discrete layers of electroplating material such as nickel, each adjacent layer having abrasive grit of a mutually distinct size dispersed therethrough.

An embodiment of tool 10 is fabricated by electroplating a relatively fine abrasive onto a steel cathode disc 11 using a suitable electroplating material (e.g., nickel) to form layer 14. A coarser grit abrasive is then electroplated onto the layer 14 to form central layer 12. Thereafter, a third layer of the first grit size abrasive is electroplated onto layer 12 to form layer 16. The resulting composite is then removed from the cathode disc 11 to form the multi-grit three-layered tool 10. The tool 10 is also hub-less, i.e., it does not include a hub or any other non-abrasive-laden component, but rather, includes abrasive dispersed substantially completely therethrough.

Where used in this disclosure, the term "axial" refers to a direction substantially parallel to central axis of rotation aof tool 10, as shown in FIG. 1. Similarly, the term "transverse" refers to a direction substantially orthogonal to the axial direction, such as along a plane substantially orthogonal to the axial direction.

Prior to discussing embodiments of the present invention in detail, a brief description of conventional electroplating is in order. Electroplating is accomplished by the use of electrolytic cells in which a direct current is applied to an anode and cathode disposed within an electrolytic bath. The baths used to apply an electroplated layer are typically aqueous, including ions of the metal to be deposited. The anode is generally fabricated from the metal to be deposited, so that metal dissolves at the anode and is deposited onto the cathode. Specific bath formulations depend upon the metal to be deposited, and are well-known in the art. Suitable electroplating materials include nickel, copper, cobalt, silver, palladium, and combinations thereof. Electroplating may be effected within a relatively broad range of temperatures. For example, copper may be electroplated using a bath at a temperature ranging from about 16 degrees C. to about 38 degrees C., with a cathode current density in the range of about 1 to 80 Amps/ft$^2$ (0.03 to 2.6 Amps/cm$^2$). A more detailed description of the process of electroplating of metals is given in the McGraw Hill Concise Encyclopedia of Science and Technology, beginning on page 692.

Turning now to FIG. 1, embodiments of the present invention will be described in greater detail. As shown, one embodiment includes a layered, multi-grit abrasive slicing disc (tool) 10. The tool includes a central layer 12 fabricated as a matrix of electroplating material with abrasive particles dispersed therethrough. Central layer 12 is sandwiched between two outer layers 14 and 16, each of which are also fabricated as a matrix of electroplating material and abrasive. The abrasive particles of central layer 12 are larger than those of outer layers 14 and 16, to provide the multi-grit aspect of tool 10. Advantageously, the larger abrasive of the central layer facilitates relatively high feed rates during use, while the finer abrasive of outer layers 14, 16 advantageously applies a high quality surface finish to the workpiece. Cutting operation of tool 10 will be discussed in greater detail hereinbelow with respect to FIG. 2.

A method of fabrication of tool 10 will now be described in detail, with reference to the following Table 1. This method includes providing 20 a deposition disc 11 (shown in phantom in FIG. 1) fabricated from a rigid, electrically conductive material such as steel or stainless steel. As also shown, disc 11 is provided with a central mounting hole 18 (FIG. 1) for mounting to a shaft or arbor (not shown), through which electrical current may pass during the electroplating process. In exemplary embodiments, the arbor is configured for being rotationally coupled to a motor, so that the disc(s) 11 disposed thereon may be rotated during electroplating operations. Such rotation helps to insure uniform application of layers 12,14,16, as discussed hereinbelow.

As shown in FIG. 1, disc 11 may sized so that its (transversely oriented) deposition face has a greater surface area than that of the desired finished tool 10. For example, in the embodiment shown, disc 11 includes an axial thickness of at least about 0.25 inches (0.63 cm), and a (transverse) diameter of 4.5-5 inches (11.4-12.7 cm). Portions of the deposition face 19 of the disc 11, such as at the outer perimeter and at an inner annular portion adjacent mounting hole 18, may then be optionally masked 24 (e.g., with tape and/or with a round mounting nut or flange) as desired to reduce the effective size of the deposition area. Furthermore, in many instances it is desirable to leave an unobstructed deposition area that is slightly greater than that of the desired finished tool 10, to compensate for material removed during finishing, as discussed hereinbelow.

The face of the cathode disc 11 may be passivated 22 by allowing the surface to oxidize. This may be accomplished, for example, by placing disc 11 in a solution of 50 percent nitric acid and 50 percent DI water for approximately five minutes. The resulting oxide layer tends to prevent a deposited layer 14 from forming a strong bond thereto, to facilitate subsequent removal of the layer from the disc. In this manner, disc 11 effectively serves as a template or mold for the finished tool 10.

Although discs 11 having a single deposition face are generally desired, the skilled artisan will recognize that a disc having two opposed deposition faces may also be used, without departing from the spirit and scope of the invention.

Deposition disc 11 is then placed 26 in a first plating bath containing ions of the electroplating material to be deposited. The bath also includes abrasive of a first size (e.g., 2-10 micron, or in particular embodiments, 4-8 micron diamond) dispersed therein. The bath is contained within a conventional electroplating apparatus, with an anode fabricated from the electroplating material (e.g., nickel). A suitable anode is an 'S-Nickel Round' nickel rod available from Falconbridge Limited, Ontario, Canada. A suitable bath is an industry standard 'Watts' nickel bath, which includes a mixture of about 30% nickel sulfate, 8-10% nickel chloride, and 5% boric acid.

The bath may be mixed 28, using a mixer of the type familiar to those skilled in the art, operated at a controlled level of agitation to keep the abrasive grits suspended in the bath. Moreover, as mentioned hereinabove, the deposition disc 11 may be optionally rotated 30 about its axis a during electroplating, to facilitate even deposition of layer 14. Layer 14 is then deposited 32 by applying an electrical current (e.g., about 20 to 40 amps, or about 30 Amps/ft$^2$ (1 Amp/cm$^2$), at about 12 Volts DC) for a suitable duration to achieve a thickness of about 1.5 times that of the final desired thickness. This extra 50 percent thickness allows for material removal during finishing (e.g., finish lapping) as discussed below.

In particular embodiments, the deposition of layer 14 includes an initial 'strike', which entails applying a relatively high current (e.g., 30-40 Amps) for a short period of time (e.g., ½ minute), to quickly deposit an initial nickel coating (e.g., about 50 microns thick). Once the strike is complete, the current may be lowered to conventional levels (e.g., about 20-30 amps) to continue deposition until the desired thickness (e.g., 1.5 times final thickness) is achieved.

After layer 14 is deposited on the deposition disc 11, the assembly is removed 34 from the first bath and rinsed 36 with de-ionized (DI) water. Thereafter, the exposed surface of layer 14 is activated 38 (e.g., with an acid). This activation removes any oxidation formed during the electroplating process, to promote adhesion of a subsequent layer thereto. In particular embodiments, this surface activation is accomplished by applying a solution (e.g., about 10% in water) of hydrochloric acid (HCL) to the face of layer 14. The face is then rinsed 40 again with DI water. In these embodiments, the foregoing rinsing steps 36 and 40 are used to keep disc 11 wet, since drying may adversely affect the uniformity of the layers.

The assembly may then be placed 42 in a second plating bath, which is similar to the first bath, but contains larger (e.g., about 3-6 times the size of the fine grit of the first bath, or in particular embodiments, 10-20 micron diamond) abrasive dispersed therein. In light of the larger abrasive size, appropriate adjustments may be made to the level of agitation, rotation speed, plating time, and bath contents. Any such adjustments would be familiar to the skilled artisan in light of the present disclosure. The deposition time may be selected to achieve a thickness nominally equal to (rather than 1.5 times) the desired final thickness of layer 12. For example, after an initial strike of about one minute, deposition of layer 12 may proceed for about 25-35 minutes at 20-25 amps at 12 VDC. The bath may be mixed 44 and the disc 11 rotated 46 in the manner described hereinabove with respect to layer 14. Once the desired thickness has been attained 48, steps 34-40 may be repeated to remove the assembly from the bath, rinse in DI water, reactivate the surface with 10% HCL, and rinse again, as described hereinabove.

Although the final thickness of layer 12 is shown in the Figures as being approximately equal to that of layer 14, the skilled artisan will recognize that the thickness of layer 12 may be less than, or in many desired embodiments, substantially greater than, that of layer 14 and/or layer 16, without departing from the spirit and scope of the present invention. Indeed, in many embodiments, it may be advantageous for central layer 12 to be substantially thicker than outer layers 14 and 16, to increase the area of contact between the periphery of layer 12 and the workpiece 60, as discussed hereinbelow with respect to FIG. 2.

Steps 26-36 may then be repeated, substantially as described hereinabove with respect to layer 14, to deposit layer 16 onto layer 12. Thereafter, the three superposed layers 12, 14, and 16, may be removed 54 as a single unit from the face of cathode disc 11, to form three-layer tools 10. The tools 10 may then be finished 56 using conventional techniques, such as OD/ID finishing to insure that diameters d1 and d2 (FIG. 1) are within desired tolerances, and double-side lapping to insure that the exterior surface flatness and axial thickness are within desired tolerances. The resulting finished tools are hub-less, multi-abrasive-laden layers of electroplating material, which, in the example shown and described, include layers of nickel with abrasive dispersed substantially entirely therethrough.

Any number of discs 11 may be mounted on a single arbor without departing from the spirit and scope of the present invention. Moreover, rather than being mounted to an arbor, one or more discs 11 may be carried in a basket, or may be otherwise supported within the electroplating baths. Regardless of the number of discs or the manner in which the disc(s) are supported, the skilled artisan will recognize that the placement in the bath, including the distance between multiple discs, may be held constant throughout the electroplating operations to help insure uniform deposition of layers 12, 14, and 16.

TABLE 1

| | |
|---|---|
| 20 | provide a deposition disc 11 |
| 22 | passivate cathode disc 11 |
| 24 | optionally mask outer perimeter and an annular portion adjacent mounting hole 18 |
| 26 | place deposition disc 11 in a first plating bath |
| 28 | mix bath |
| 30 | optionally rotate disc 11 about its axis |
| 32 | deposit layer to 1.5 times desired final thickness |
| 34 | remove assembly from the first bath |
| 36 | rinse off with de-ionized (DI) water. |
| 38 | activate surface |
| 40 | rinse with DI water |
| 42 | place in a second plating bath |
| 44 | mix bath |
| 46 | optionally rotate disc 11 about its axis |
| 48 | deposit layer 12 until desired final thickness is attained |
| 50 | repeat steps 34-40 |
| 52 | repeat steps 26-36 |
| 54 | remove the three superposed layers from cathode disc to |

TABLE 1-continued

| | |
|---|---|
| | form tool 10 |
| 56 | finish tool 10 |

Figure 2:
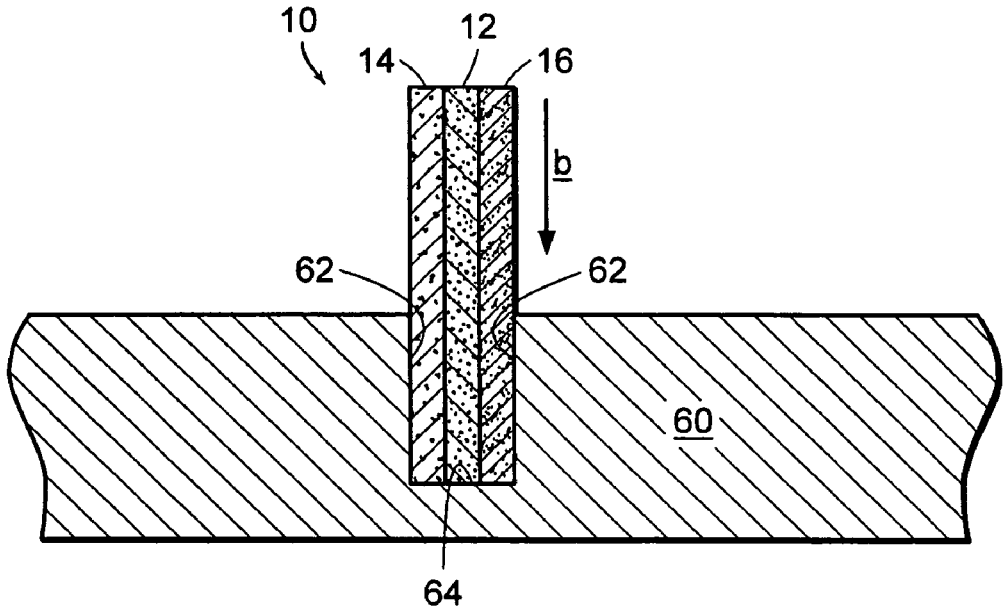
FIG. 2 is a transverse cross-sectional view of a portion of the cutting tool of FIG. 1, during an abrasive cutting operation.

Referring now to FIG. 2, tool 10 is operated by initially mounting it via mounting hole 18 on the spindle of a conventional cutting machine (e.g., power saw) for rotation about its axis a(FIG. 1). The tool 10 may then be moved transversely (in direction b) into cutting engagement with a workpiece 60 to form a kerf defined by surfaces 62 and 64 as shown. As cutting progresses, the relatively fine grit of outer layers 14 and 16 provide surfaces 62 of the workpiece 60 with a relatively good finish (e.g., with low levels of chipping). Simultaneously, the courser central layer 12 facilitates rapid material removal from surface 64 of the workpiece, to enable relatively high feed rates.

The following illustrative examples are intended to demonstrate certain aspects of the present invention. It is to be understood that these examples should not be construed as limiting.

EXAMPLES

Example 1

Cutting tools 10, as shown in FIG. 1, were fabricated, each having a finished outer diameter d1 of 4.4 inches (11.2 cm), an inner diameter d2 of 3.5 inches (8.9 cm), and three layers of nominally equal thickness, for a total axial thickness t of 0.0038 inches (0.01 mm). Three deposition (cathode) discs 11 were used, which were fabricated from 304 stainless steel with an axial thickness of 0.25 inches (0.63 cm), and an effective deposition surface area slightly greater than that of the finished tools 10, to permit material removal during finishing. All three discs 11 were mounted to a single stainless steel shaft. The faces of the cathode discs 11 were passivated in a nitric acid solution as discussed hereinabove. The assembly was immersed in a first plating bath containing 4-8 micron diamond abrasive dispersed in a Watts nickel bath. An 'S-Nickel Round' anode (Falconbridge, Ontario Canada) was used. Electroplating began with a ½ minute strike at 30 amps, followed by plating for 56 minutes at 21 amps and 12 VDC. The assembly was then removed from the first bath and rinsed with DI water, activated with a solution of 10% HCL, and then rinsed again with DI water. The assembly was then immersed in a second plating bath nominally identical to the first bath, including the nickel anode, but with 10-20 micron diamond abrasive dispersed therein. Following a ½ minute strike 30 amps, the assembly was plated for 31 minutes at 21 amps and 12 VDC. It was then rinsed in DI water, reactivated with 10% HCL, and rinsed again.

The assembly was then immersed again in the first 4-8 micron bath, where it was struck for ½ minute at 30 amps, and then plated again for 60 minutes at 21 amps, 12 VDC. During electroplating of all three layers 12, 14, and 16, the assembly was rotated about its axis, while the plating baths were agitated.

The assembly was then removed from the tank, rinsed, and the cathode discs removed from the stainless steel shaft. The electroplated layers were then removed from the stainless steel cathode discs, to form three, three-layer tools 10. The tools 10 were finished using conventional OD/ID finishing and double-side lapping techniques, the latter of which removed about one third of the thickness of each outer layer 14 and 16, to yield a total final thickness t of about 0.0038 inches (0.1 mm).

Example 2

Cutting tools 10 were fabricated substantially as described in Example 1, though using 2-4 micron diamond abrasive for outer layers 14 and 16, and using 4-8 micron diamond abrasive for inner layer 12.

Test Results

Discs 10, fabricated according to Example 1, hereinabove, were tested in wafer cutting operations used in the manufacture of read/write heads for the electronics industry. Blank AlTiC wafers, measuring 114.30 mm×114.30 mm×1.25 mm, were mounted on 3.175 mm thick lava bonded to a steel plate. Tools 10 were mounted to a MTI Model MSS-816 cutting machine (Manufacturing Technology, Inc. (MTI) Ventura, Calif.). A series of cuts were made into the wafers under the conditions listed in Table 2.

TABLE 2

| | |
|---|---|
| Tool 10 diameter: | 4.4 inches (11.2 cm) |
| RPM: | 9,000 (52.7 m/s) |
| Coolant: | 3.5 gal/min (13.25 l/min), through a ¼ inch (6.4 mm) round nozzle |
| Depth of Cut: | 1.52 mm |
| Cut length per pass: | 114.3 mm |

The cuts were made at a range of feed rates, as shown in Table 3:

TABLE 3

| | RUN | | | | | | | | |
|---|---|---|---|---|---|---|---|---|---|
| | A | B | C | D | E | F | G | H | I |
| Number of Cuts | 50 | 10 | 10 | 10 | 10 | 10 | 10 | 10 | 40 |
| Feed Rate (mm/min) | 102 | 152 | 203 | 254 | 305 | 356 | 406 | 457 | 508 |
| Average Chip Size (microns) | 1.7 | 1.2 | 1.6 | 1.2 | 1.8 | 1.2 | 1.7 | 2.1 | 1.6 |

The surface finish of the workpieces (wafers) was analyzed by measuring the size of chips in the surfaces. The results, also shown in Table 3, indicate that the average chip size remains at or below about 2 microns even at the highest feed rates tested. These results are significantly better than commonly accepted quality standards for conventional wafer-cutting MMC and electroplated discs, in which results are considered satisfactory as long as the average chip size does not exceed about 5 microns at feed rates of 152-203 mm per minute.

Although embodiments of the present invention have been described as utilizing diamond abrasive, the skilled artisan will recognize that substantially any type of abrasive particulate, such as diamond, CBN, fused alumina, sintered alumina, silicon carbide, and combinations thereof, may be used without departing from the spirit and scope of the present invention.

In the preceding specification, the invention has been described with reference to specific exemplary embodiments thereof. It will be evident that various modifications and changes may be made thereunto without departing from the broader spirit and scope of the invention as set forth in the claims that follow. The specification and drawings are accordingly to be regarded in an illustrative rather than restrictive sense.

Having thus described the invention, what is claimed is:

1. A method for fabricating an abrasive cutting tool, the method comprising:

(a) providing a deposition disc having at least one deposition surface;

(b) placing the disc in a bath having a fine grit abrasive dispersed therein;

(c) depositing a first layer of the fine grit abrasive and electroplating material onto the deposition surface;

(d) removing the disc from the bath;

(e) activating a surface of the first layer;

(f) placing the disc in a bath having a second abrasive of a second grit size larger than that of the fine grit abrasive dispersed therein;

(g) depositing a second layer of the second abrasive and electroplating material onto the first layer;

(h) removing the disc from the bath;

(i) activating a surface of the second layer;

(j) placing the disc in a bath having the fine grit abrasive dispersed therein;

(k) depositing a third layer of the fine grit abrasive and electroplating material onto the second layer; and (l) removing the disc from the first layer, to produce a multi-layered cutting tool having abrasive particulate dispersed substantially completely therethrough, with a central layer of second grit size abrasive disposed between two layers of fine grit abrasive.

2. The method of claim 1, further comprising passivating the deposition surface prior to said placing (b).

3. A method for fabricating an abrasive cutting tool, the method comprising:

(a) depositing a first layer of a first grit size abrasive and electroplating material onto a surface of a deposition member;

(b) depositing a second layer of a second grit size abrasive larger than the first grit size abrasive and electroplating material onto the first layer;

(c) depositing a third layer of a third grit size abrasive smaller than the second grit size abrasive and electroplating material onto the second layer;

(d) configuring at least two of the first, second, and third sizes to be mutually distinct from one another; and (e) removing the deposition member from the first layer, to produce a multilayered cutting tool having abrasive particulate dispersed substantially completely therethrough.

4. The method of claim 3, wherein said configuring (d) comprises configuring the third-size to be substantially equivalent to the first-size.

5. The method of claim 4, wherein the depositing (c) comprises placing the second layer in a bath including the first grit size abrasive particulate dispersed therein.

6. The method of claim 5, comprising mixing the bath.

7. The method of claim 3, comprising passivating the surface of the deposition member prior to the depositing (a).

8. The method of claim 3, comprising activating a surface of the first layer prior to the depositing (b).

9. The method of claim 3, comprising activating a surface of the second layer prior to the depositing (c).

10. The method of claim 3, wherein the depositing (a) comprises placing the deposition member in a first bath including the first grit size abrasive dispersed therein.

11. The method of claim 10, comprising mixing the first bath.

12. The method of claim 3, wherein the depositing (b) comprises placing the first layer in a second bath including the second grit size abrasive dispersed therein.

13. The method of claim 12, comprising mixing the second bath.

14. The method of claim 3, wherein the depositing (a), (b), and (c) further comprises rotating the deposition member about a central axis.

15. The method of claim 3, wherein the depositing (a) comprises depositing the first layer to a greater than desired final thickness.

16. The method of claim 15, comprising finishing the tool by removing material from the first layer until the desired final thickness is attained.

17. The method of claim 3, wherein the depositing (b) comprises depositing the second layer to a desired final thickness.

18. The method of claim 3, wherein the depositing (c) comprises depositing the third layer to a greater than desired final thickness.

19. The method of claim 18, comprising finishing the tool by removing material from the third layer until the desired final thickness is attained.

20. The method of claim 3, wherein the depositing (a), (b), and (c), comprise depositing electroplating material selected from the group consisting of nickel, copper, cobalt, silver, palladium, and combinations thereof

21. The method of claim 20, wherein the electroplating material comprises nickel.

22. The method of claim 3, wherein the abrasive particulate is selected from the group consisting of diamond, CBN, fused alumina, sintered alumina, silicon carbide, and combinations thereof.

23. The method of claim 3, comprising passivating the deposition surface prior to said depositing (a).

24. The method of claim 3, wherein the first grit size and the third grit size are within a size range of:

at least about two microns; and up to about ten microns.

25. The method of claim 24, wherein the first grit size and the third grit size are within a size range of:

at least about four microns; and up to about eight microns.

26. The method of claim 24, wherein the second grit size is within a range of:

at least about six microns; and up to about sixty microns.

27. The method of claim 24, wherein the second grit size is within a range of:

at least about ten microns; and up to about twenty microns.

* * * * *